US007957681B2

(12) United States Patent
Shigehiro

(10) Patent No.: US 7,957,681 B2
(45) Date of Patent: Jun. 7, 2011

(54) DEVELOPING DEVICE

(75) Inventor: Koji Shigehiro, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/722,945

(22) Filed: Mar. 12, 2010

(65) Prior Publication Data

US 2010/0247164 A1 Sep. 30, 2010

(30) Foreign Application Priority Data

Mar. 27, 2009 (JP) ..... 2009-078965

(51) Int. Cl.
*G03G 15/09* (2006.01)

(52) U.S. Cl. ..... 399/271; 399/119; 399/120

(58) Field of Classification Search ..... 399/53–55, 399/110, 119, 120, 252, 264, 265, 267, 270, 399/271

See application file for complete search history.

(56) References Cited

U.S. PATENT DOCUMENTS 5,473,416 A * 12/1995 Endou et al. ..... 399/265
5,581,336 A 12/1996 Matsuzaki et al.
5,701,553 A * 12/1997 Endo et al. ..... 399/55
5,911,098 A * 6/1999 Gyotoku et al. ..... 399/264
6,009,295 A * 12/1999 Kimura et al. ..... 399/257
2008/0206661 A1* 8/2008 Fujishima et al. ..... 430/48

FOREIGN PATENT DOCUMENTS

JP 7-146603 A 6/1995
JP 7-271193 A 10/1995
JP 7-271993 A 10/1995
JP 8-240972 9/1996
JP 11-174848 A 7/1999

* cited by examiner

*Primary Examiner* — Hoan Tran
(74) *Attorney, Agent, or Firm* — Fitzpatrick, Cella, Harper & Scinto

(57) ABSTRACT

A developing device includes a developing container in which a developer is contained; a developer carrying member for carrying the developer and feeding the developer by rotation thereof to a developing zone in which the developer carrying member opposes an image bearing member on which a latent image is formed and develops the latent image with the developer; and an electrode, disposed opposed to the developer carrying member, to which a bias for forming an electric field for moving regular-charge toner in the developer container toward the developer carrying member is to be applied. The electrode is provided downstream of the developing zone with respect to a rotational direction of the developer carrying member and is provided vertically above the developer carrying member. At least a part of the electrode is located downstream of a rectilinear line connecting a rotation center and top point of the developer carrying member with respect to the rotational direction of the developer carrying member.

5 Claims, 6 Drawing Sheets

DEVELOPING DEVICE

FIELD OF THE INVENTION AND RELATED ART

The present invention relates to a developing device for use with an image forming apparatus such as a copying machine or a printer.

For example, in a common image forming apparatus of an electrophotographic type, an electrode formed on an electrophotographic photosensitive member is developed with a developer into a toner image by the developing device. Then, the toner image is transferred onto a recording material (medium) and fixed as a fixed image by a fixing device, so that an image-formed product is output. In such an image forming apparatus, there is a need to prevent toner scattering to a minimum level. This is because the scattered toner contaminates the inside of the image forming apparatus to cause problems such that the contamination is extended during maintenance and that the scattered toner deposits on an exposure device such as a laser scanner opposing the photosensitive member, on a white background image forming portion on the photosensitive member, and on the developing device and a charging device.

Japanese Laid-Open Patent Application (JP-A) Hei 7-271193 describes a means for preventing or suppressing the toner scattering from the developing device. Specifically, this means includes a toner scattering preventing electrode at an end of an opening of the developing device, where the scattered toner is moved toward a developer carrying member (developing sleeve) by an electric field through the electrode and is collected by the developer carrying member to prevent the scattering of the toner to the outside of the developing device.

On the other hand, in some layouts of the developing device, the scattering preventing electrode can be disposed downstream of a developing zone in which the developer carrying member opposes the image bearing member and is disposed above the developer carrying member. In this case, the toner deposited on the scattering preventing electrode is dropped after the image formation and can be scattered to the outside of the developing device and can cause image defect.

SUMMARY OF THE INVENTION

A principal object of the present invention is to provide a developing device capable of suppressing scattering of toner to the outside of the developing device even when the toner deposited on a scattering preventing electrode after image formation.

According to an aspect of the present invention, there is provided a developing device comprising:

a developing container in which a developer including toner is contained;

a developer carrying member for carrying the developer and feeding the developer by rotation thereof to a developing zone in which the developer carrying member opposes an image bearing member on which a latent image is formed and develops the latent image with the developer; and an electrode, disposed opposed to the developer carrying member, to which a bias for forming an electric field for moving the developer including regular-charge toner in the developer container toward the developer carrying member is to be applied, wherein the electrode is disposed downstream of the developing zone with respect to a rotational direction of the developer carrying member and is disposed vertically above the developer carrying member, and wherein at least a part of the electrode is disposed downstream of a rectilinear line connecting a rotation center and top point of the developer carrying member with respect to the rotational direction of the developer carrying member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 3(*b*) is a cross-sectional view of a developing device in Comparative Embodiment 1; and FIG. 3(*c*) is a cross-sectional view of a developing device in Comparative Embodiment 2.

DETAILED DESCRIPTION OF THE PREFERRED EMBODIMENTS

Embodiment 1

General Structure and Operation of Image Forming Apparatus

Figure 1A:
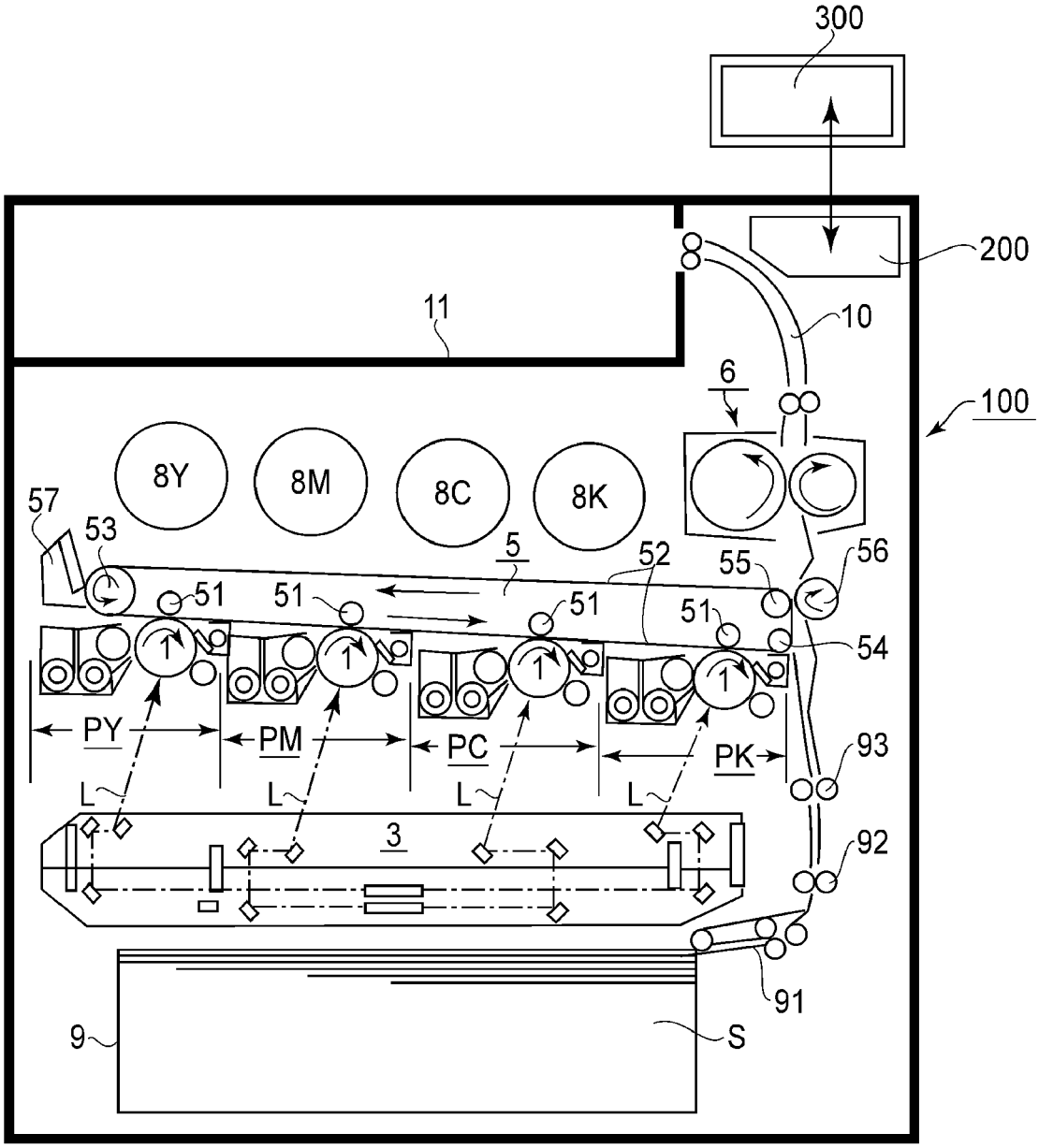
FIG. 1A is a schematic structural view of an example of an image forming apparatus in which the developing device according to the present invention is mounted.
Figure 1B:
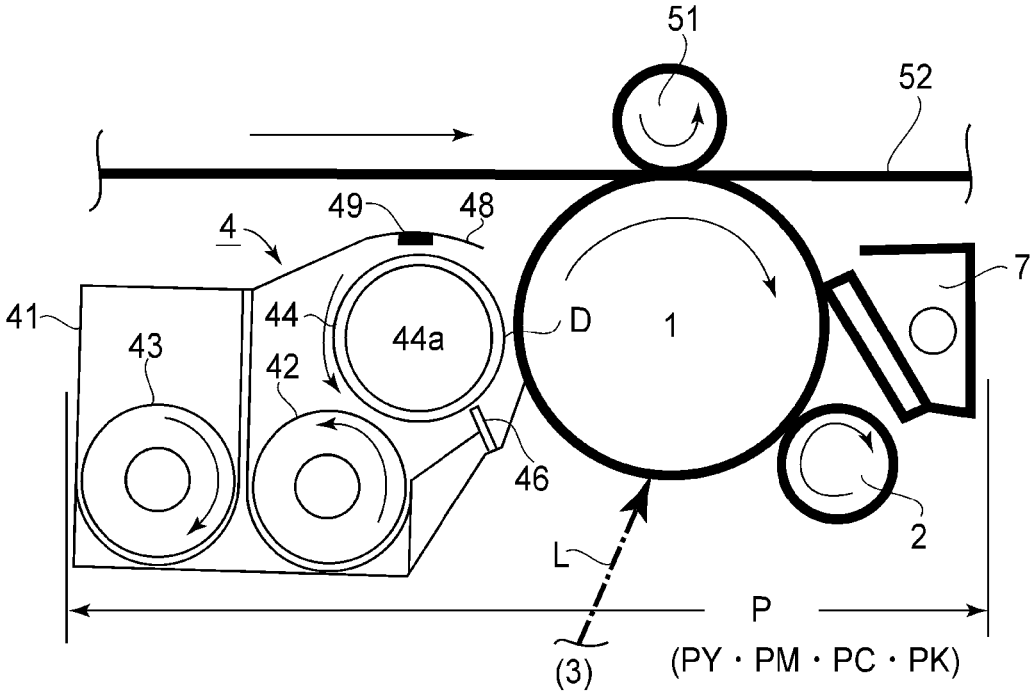
FIG. 1B is an enlarged view of one image forming portion in the image forming apparatus shown in FIG. 1A.

First, a general structure and operation of an image forming apparatus in this embodiment will be described. FIG. 1A is a schematic structural view of an example of an image forming apparatus 100 in which a developing device according to the present invention is mounted. The image forming apparatus 100 is a four color-based full-color electrophotographic apparatus of a four-drum tandem type and an intermediary transfer type. The image forming apparatus 100 performs an image forming operation depending on input image information from a host device (equipment) 300 communicatably connected to a control circuit portion 200. Thus, the image forming apparatus 100 can form full color images of four colors of yellow (Y), magenta (M), cyan (C) and black (K) on a recording material (medium) S. The host device 300 is an original reader connected to a main assembly of the image forming apparatus 100 or a personal computer or the like communicatably connected to the apparatus main assembly. The recording material S is a recording sheet (paper), a plastic sheet, a cloth, or the like. In the apparatus main assembly, a plurality of image forming portions (stations) P are disposed. In the image forming apparatus 100 in this embodiment, first to fourth image forming portions PY, PM, PC and PK for forming images of colors of Y, M, C and K are arranged substantially horizontally in a line at predetermined intervals from left to right in FIG. 1A. The respective image forming portions P are the substantially same electrophotographic process mechanism except that developing colors are different from each other. FIG. 1B is an enlarged view of one image forming portion P. Each of the image forming portions P includes a drum-like electrophotographic photosensitive member 1 as an image bearing member (hereinafter referred to as a drum). Around the drum 1, a charging roller 2 as a charging means, a developing device 4 as a developing means, a primary transfer roller 51 as a primary transfer means, and a cleaning device 7 as a drum cleaning means are disposed. On or above the image forming portions P, an intermediary transfer belt unit 5 is disposed. The belt unit 5 includes a flexible dielectric endless belt (intermediate transfer belt) 52 as an intermediate transfer member contacting an upper surface of the drum 1 at each image forming portion P. This belt 52 is stretched around three parallel rollers including a left-side driving roller 53, a right-side tension roller 54, and a secondary transfer opposite roller 55. A secondary transfer roller 56 contacts the belt 52 contacting the secondary transfer opposite roller 55. A contact portion between the belt 52 and the secondary transfer roller 56 is a secondary transfer nip. The upper surface of the drum 1 of each image forming portion P and a lower surface of a lower-side belt portion between the driving and tension rollers 53 and 54 of the belt 52 contact each other. The primary transfer roller 51 at each image forming portion P contacts a lower-side belt portion of the belt 52 contacting the upper surface of the drum 1. At each image forming portion P, a contact portion between the drum 1 and the belt 52 is a primary transfer nip. At a belt contacting portion of the driving roller 53, a belt cleaning device 57 is disposed. Below the image forming portions P, an exposure device 3 as an exposure device for exposing the drum 1 at each image forming portion P to light is disposed. In this embodiment, the exposure device 3 is a laser exposure optical device (laser scanner). The laser scanner 3 includes a polygonal mirror for effecting reflection scanning with laser light, fθ lens for forming a spot image on the drum by effecting scanning with the laser light at a constant speed, a folding-back mirror for reflecting the beam toward a predetermined direction, etc.

The operation for forming the full-color image is as follows. The drum 1 at each of the first to fourth image forming portions PY, PM, PC and PK is rotationally driven in a clockwise direction indicated by an arrow at a predetermined speed. The belt 52 is rotationally driven in a counterclockwise direction indicated by arrows (in a direction following the rotation of the drum 1) at a speed corresponding to the predetermined speed of the drum 1. The exposure device 3 is also driven. In synchronism with these drives, at each image forming portion P, the charging roller 2 uniformly charges the surface of the drum 1 to a predetermined polarity and a predetermined potential with predetermined control timing. The exposure device 3 subjects the surface of the drum 1 to the laser light L modulated depending on an image signal of each of the colors. As a result, an electrostatic image is formed on the drum 1 surface correspondingly to an associated color image signal. The formed electrostatic image is developed as a toner image by the developing device 4. By the above-described electrophotographic image forming process operation, a yellow toner image corresponding to a yellow component of the full-color image is formed on the drum 1 at the first image forming portion PY. Then, the yellow toner image is primary-transferred onto the belt 52. A magenta toner image corresponding to a magenta component of the full-color image is formed on the drum 1 at the second image forming portion PM. Then, the magenta toner image is primary-transferred onto the yellow toner image, which has already been formed on the belt 52, in a superposition manner. A cyan toner image corresponding to a cyan component of the full-color image is formed on the drum 1 at the third image forming portion PC. Then, the cyan toner image is primary-transferred onto the yellow and magenta toner images, which have already been formed on the belt 52, in the superposition manner. A black toner image corresponding to a black component of the full-color image is formed on the drum 1 at the four image forming portion PK. Then, the black toner image is primary-transferred onto the yellow, magenta and cyan toner images, which have already been formed on the belt 52, in the superposition manner. The primary transfer of the toner image from the drum 1 onto the belt 52 at each image forming portion P is performed by applying a predetermined primary transfer bias, of an opposite polarity to the charge polarity of the toner, to the primary transfer roller 51. Thus, on the belt 52, a multiple toner image of Y, M, C and K (unfixed four color-based full-color image) is formed. At each image forming portion P, the toner remaining on the drum 1 surface after the primary transfer is removed and collected by the cleaning device 7. Then, the developing sleeve 1 is prepares for a subsequent image forming step.

The recording material S accommodated in a cassette 9 as a recording material accommodating portion is conveyed to the secondary transfer nip, at which the belt 52 and the secondary transfer roller 56 contact each other, by recording material conveying (feeding) members including a pick-up mechanism 91, conveying rollers 92, registration rollers 93, etc. The recording material S is conveyed to the secondary transfer nip in synchronism with the toner images on the belt 52 by the registration rollers 93. Then, the multiple toner images on the belt 52 are collectively secondary-transferred onto the recording material S in the secondary transfer nip by the action of a secondary transfer bias (of an opposite polarity to the toner charge polarity) applied to the secondary transfer roller 56. The recording material S coming out of the secondary transfer nip is separated from the belt 52 and is conveyed into a fixing device 6. The multiple toner images transferred onto the recording material S are melt-mixed under heat and pressure and are fixed on the recording material S. Then, the recording material S passes through a conveying path 10 and is discharged on a sheet discharge tray 11 as a full-color image formed product. A deposited matter such as the toner remaining on the belt 52 after the secondary transfer step is removed and collected by the belt cleaning device 57. Incidentally, the image forming apparatus 100 can also form a single color image (e.g., a black image) or a multi-color image by using a desired single image forming portion or some of the four image forming portions. Toner cartridges 8Y, 8M, 8C and 8K of yellow, magenta, cyan and black are mounted in predetermined mounting portions in the image forming apparatus so as to be replaced with new ones. Each toner cartridge 8 accommodates an associated color toner to be supplied to an associated developing device 4. By an operation of an automatic toner supply control mechanism (ATR: automatic toner replenisher), an appropriate amount of the toner is supplied from the toner cartridge 8 to the developing device 4 as desired.

(Developing Device)

Figure 2:
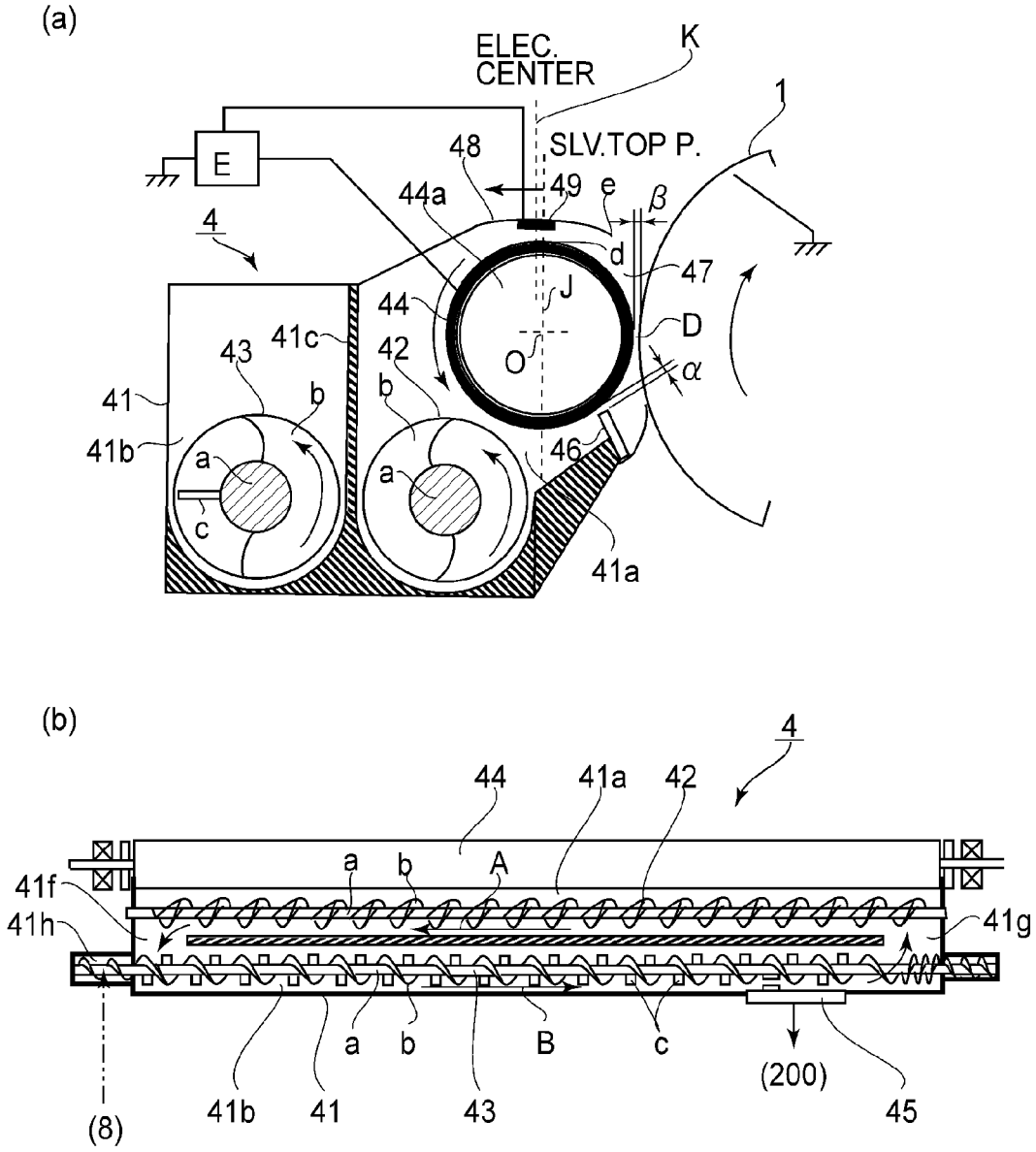
FIG. 2(*a*) is a cross-sectional view of the developing device in Embodiment 1 and FIG. 2(*b*) is a longitudinal plan view thereof.

The developing device 4 at each image forming portion P uses a two component developer, as the developer, including non-magnetic toner particles (toner) and magnetic carrier particles (carrier). That is, the two component developer including the toner and the carrier is carried on the developer carrying member and a developing bias in the form of a DC voltage biased with an AC voltage is applied to the developer carrying member to supply the developer to the electrostatic image formed on the image bearing member, so that the electrostatic image is developed into the toner image. FIG. 2(*a*) is an enlarged cross-sectional view of the developing device 4 and FIG. 2(*b*) is a longitudinal plan view of the developing device 4. The developing device 4 is elongated in a rotational shaft (axis) direction of the drum 1 as the image bearing member and includes a developing container 41 containing the two-component developer (not shown). In the developing container 41, a developing sleeve 44 as the developer carrying member is disposed. In the developing sleeve 44, a magnet roller (magnet) 44*a* as a magnetic field generating means is fixedly disposed in a non-rotation manner. Further, in the developing container 41, a developing blade 46 as a developer regulating member for forming a thin layer of the developer on the surface of the developing sleeve 44, and first and second developer feeding members 42 and 43 for stirring and conveying the developer in the developing container 41. The inside of the developing container 41 is partitioned into a drum 1—side developing chamber (developer feeding path) 41*a* and a stirring chamber (developer feeding path) 41*b* on an opposite side to the drum 1 side by a partition wall 41*c* extending in a longitudinal direction and vertical direction of the developing container 41. In the developing chamber 41*a*, the first developer feeding member 42 is disposed and in the stirring chamber 41*b*, the second developer feeding member 43 is disposed. The first developer feeding member 42 extends in the longitudinal direction of the developing chamber 41*a* and the second developer feeding member 43 extends in the longitudinal direction of the stirring chamber 41*b*. To one longitudinal end portion (left end portion in FIG. 2(*b*)) and the other longitudinal end portion (right end portion in FIG. 2(*b*)) of the partition wall 41*c*, transfer portions (developer feeding paths) 41*f* and 41*g* for permitting passage of the developer between the developing chamber 41*a* and the stirring chamber 41*b* are provided.

In this embodiment, each of the first and second developer feeding members 42 and 43 is a screw-like member (hereinafter, referred to as a first screw and a second screw, respectively). That is, in this embodiment, each of the first and second screws 42 and 43 is formed by providing a spiral blade b as a feeding portion around a magnetic shaft (rotation shaft) a. Further, in this embodiment, the second screw 43 also includes, in addition to the blade b, a stirring rib c which is radially projected from the shaft a and has a predetermined width with respect to a developer feeding direction. The rib c stirs the developer by the rotation of the shaft a. The first screw 42 stirs the developer in the developing chamber 41*a* and feeds the developer in a left direction indicated by an arrow A in FIG. 2(*b*). The second screw 43 stirs the developer in the stirring chamber 41*b* and feeds the developer in a right direction indicated by an arrow B in FIG. 2(*b*). The stirring chamber 41*b* is provided with a toner supplying portion 41*h* at one longitudinal end portion (left end portion in FIG. 2(*b*)) and provided with a developer content (concentration) sensor (inductance sensor) 45 at the other longitudinal end portion (right end portion in FIG. 2(*b*)). The developer content sensor 45 detects the toner content of the developer in the developing container 41 and detected information is input into the control circuit portion 200. The control circuit portion 200 controls the automatic toner supply control mechanism (not shown) on the basis of the input detected information so that the toner is supplied from the toner cartridge 8 to the toner supplying portion 41*h* so as to keep the detected toner content input from the developer content sensor 45 within a predetermined range. The toner supplied to the toner supplying portion 41*h* centers the stirring chamber 41*b* by the second screw 43 and is fed in the B direction in the stirring chamber 41*b* while being stirred and mixed with the developer which has already been present in the stirring chamber 41*b*, thus resulting in uniformized toner content. The first and second screws 42 and 43 are disposed in parallel along the rotational shaft direction (developing width direction) of the developing sleeve 44. The first screw 42 and the second screw 43 feed the developer in mutually opposite directions along the rotational axis direction of the developing sleeve 44. Thus, the developer is circulated in the developing container 41 through communicating portions 41*f* and 41*g* by the first and second screws 42 and 43. That is, by a feeding force of the first and second screws 42 and 43, the developer in the developing chamber 41*a* lowered in toner content by the toner consumption in the developing step is moved into the stirring chamber 41*b* through one communicating portion 41*f*. Further, the developer in the stirring chamber 41*b* in which the supplied toner is stirred is moved toward the developing chamber 41*a* through the other communicating portion 41*g*.

The developing chamber 41*a* is provided with an opening 47 at a position corresponding to the developer in which the developing sleeve 44 opposes the drum 1. At the opening 47, the developing sleeve 44 is disposed rotatably and substantially in parallel to the drum 1 so that a part of a peripheral surface thereof is exposed through the opening 47. In this embodiment, the developing sleeve 44 is constituted by a non-magnetic material and is rotationally driven in the counterclockwise direction indicated by the arrow in FIG. 2(*a*) at a predetermined speed. Inside the developing sleeve 44, the magnet roller 44*a* having a plurality of magnetic poles along its peripheral surface is disposed as the magnetic field generating means in a non-rotationally fixed manner. The developing sleeve 44 rotates around the fixed magnet roller 44*a*. The developer in the developing chamber 41*a* is supplied to the developing sleeve 44 by the first screw 42. The developer supplied to the developing sleeve 44 is carried on the developing sleeve 44 in a predetermined amount to create a developer stagnated portion. The developer on the developing sleeve 44 passes through the developer stagnated portion by the rotation of the developing sleeve 44 and a layer thickness of the developer is regulated by the developing blade 46 and then the developer is fed to the developing zone D. The developing blade 46 opposes the developing sleeve 44 with a predetermined gap $\alpha$. The developing sleeve 44 opposes the drum 1 with a predetermined gap $\beta$. A closest portion between the developing sleeve 44 and the drum 1 is the developing zone D. In the developing zone d, the developer on the developing sleeve 44 form a chain thereof to create a magnetic chain of the developer. In this embodiment, the magnetic chain is brought into contact with the drum 1 to supply the toner of the developer to the drum 1, so that the electrostatic image on the drum 1 is developed into the toner image. Further, in order to improve a developing efficiency, i.e., a toner imparting rate with respect to the electrostatic image, generally, a developing bias voltage in the form of the DC voltage biased with the AC voltage is applied from a developing bias source E as a voltage application means to the developing sleeve 44. The developer on the developing sleeve 44 after the supply of the toner to the drum 1 is returned to the developing chamber 41*a* by further rotation of the developing sleeve 44. That is, the developing sleeve 44 as the developer carrying member is internally provided with the magnet roller 44*a*. By the magnetic field of the magnet roller 44*a* at its peripheral surface, the developing sleeve 44 carries and feeds the developer to the developing zone D as the closest portion between the drum 1 and itself while being rotated, so that the electrostatic image formed on the drum 1 as the image bearing member is developed with the developer. The developing blade 46 as the developer regulating member is disposed upstream of the developing zone D with respect to the rotational direction of the developing sleeve (developer carrying member) and below the developing sleeve 44 with respect to a vertical direction of the developing sleeve 44 and regulates the layer thickness of the developer carried on the developing sleeve 44.

(Scattering Preventing Electrode)

With respect to the above-described developing device 4, an upper cover 48 of the developing container 41 has a shape such that a surface thereof at which it opposes the developing sleeve 44 is curved along the surface of the developing sleeve 44 with a spacing. To this container 48, a scattering preventing electrode (hereinafter referred to as an electrode) 49 capable of applying a voltage at which the scattering of the developer (toner) is prevented is disposed. The electrode 49 is extended in parallel to the developing sleeve 44 as the developer carrying member. Further, the electrode 49 is, as shown in FIG. 2(*a*), disposed vertically above the developing sleeve 44. Further, at least a part of the electrode 49 is present downstream of a rectilinear line (vertical line) passing through a rotation center O of the developing sleeve 44 and a top point ("SLV. TOP P.") d of the developing sleeve 44 with respect to the rotational direction of the developing sleeve 44 (developer carrying member). A rectilinear line K represents a vertical line passing through a width center ("ELEC. CENTER") of the electrode 49.

Figure 3:
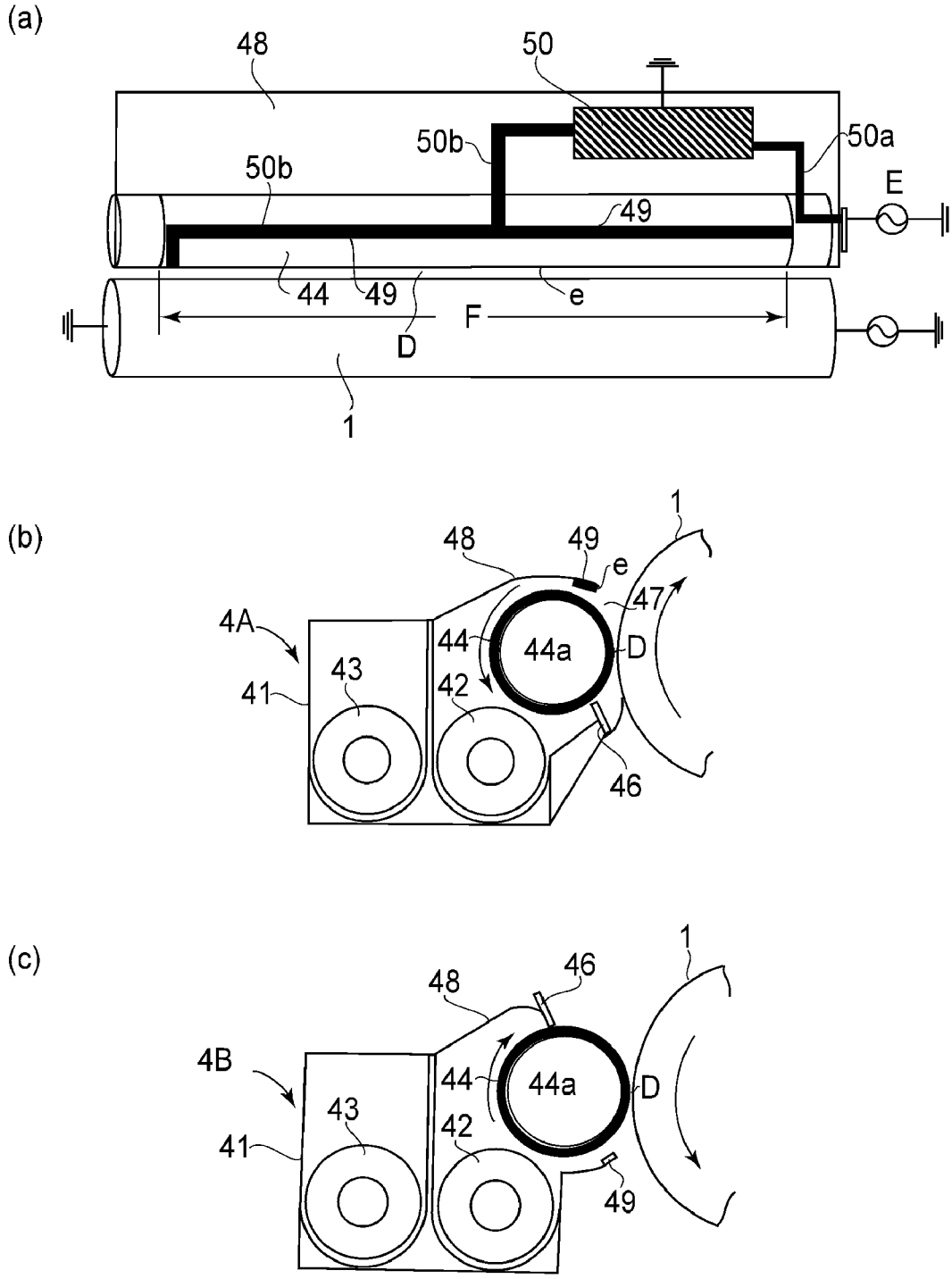
FIG. 3(*a*) is a schematic view showing a positional relationship among a drum, a developing sleeve, an upper cover, a scattering preventing electrode, and a rectifying substrate.

Generally, in the case where the negatively chargeable toner is used, as a developer scattering preventing bias, a voltage is applied to the electrode 49 so that an electric field is generated in a direction in which weakly negatively charged toner which is insufficiently charged and is liable to scatter by centrifugal force of the developing sleeve 44 is urged against the developing sleeve 44. That is, the bias to be applied to the electrode 49 has an identical polarity to the toner charge polarity with respect to the DC bias to be applied to the developing sleeve 44. To the electrode 49, there is no need to provide an additional power source, a bias rectified to the DC bias is applied from wiring of the developing (AC) bias, to be applied to the developing sleeve 44, through a rectifying substrate provided to the container upper cover 48. FIG. 3(*a*) is a schematic view showing a positional relationship among the drum 1, the developing sleeve 44, the upper cover 48, the electrode 49, and a rectifying substrate 50 in this embodiment. As the electrode 49, a sheet-like composite material ("AL-PET" mfd. by PANAC Corp.; aluminum foil/PET lamination film; aluminum foil conducting wire) having a width of 4 mm was used. The electrode 49 is disposed on a back surface of the container upper cover 48 and vertically above the developing sleeve 44 in a length equal to a blast area F in which the developer is fed in the longitudinal direction of the developing sleeve 44. Further, the electrode 49 is located, at a position of 7 mm from an end (opening end) e on the opening 47 side of the container upper cover 48, downstream of the developing sleeve 44 with respect to the rotational direction of the developing sleeve 44. In this embodiment, this electrode 49 has an electrode center located 1 mm downstream of a rectilinear line J passing through a rotation center O and top point d of the developing sleeve 44 with respect to the rotational direction of the developing sleeve 44. The rectifying substrate 50 is provided on an upper surface of the container upper cover 48 and is electrically connected to a power source E through a wiring line 50*a*. Further, the rectifying substrate 50 is electrically connected to the electrode 49 through a wiring line 50*b*. Here, the scattering preventing electrode generally has a width (with respect to the sleeve rotational direction) of about 5 mm. The width of the scattering preventing electrode is at least ⅓ or less of the diameter of the developer carrying member. In general, the scattering preventing electrode is constituted by a metal plate or a metal foil seal having a width of several millimeters (at least 6 to 7 mm or less) in many cases, so that even when a downstream end of the electrode overlaps with the rectilinear line J, an opposite end of the electrode is located at the position of the upper cover end e.

FIG. 3(*b*) shows a constitution of a developing device 4A in Comparative Embodiment 1. In this developing device 4A, the scattering preventing electrode 49 is disposed at the end (opening end) e on the opening 47 side of the container upper cover 48. Other constitutions of the developing device 4A are similar to those of the developing device 4 in Embodiment 1. Comparison between the developing device 4 in Embodiment 1 and the developing device 4A in Comparative Embodiment 1 was made with respect to levels of toner scattering and falling in drops of the toner from the container upper cover 48. First, the comparison with respect to the scattering level was made by performing idling of the developing device 4 and the developing device 4A in a high temperature/high humidity (30° C./80% RH) environment. Specifically, each of the developing devices is mounted in an idling device which includes only a driving device for the developing device and is capable of permitting drive of the developing device alone. A voltage of −600 V is applied from an external power source to the electrode 49 and the developing sleeve 44 is connected to the ground. Further, white paper (sheet) is wound around the developing device and the developing device is subjected to idling for 2 hours at a rotational speed corresponding to 50 cpm while containing the two component developer having a T/D (toner weight/developer weight) ratio of 10%. Then, an amount of toner scattered and deposited on the white paper was compared. As a result, the toner scattering level at the container upper cover 48 of the developing device 4A in Comparative Embodiment 1 and that at the container upper cover 48 of the developing device 4 in Embodiment 1 were equal to each other. Thus, with respect to the positions of the scattering preventing electrode in the developing device 4 in Embodiment 1 and the developing device 4A in Comparative Embodiment 1, the same collecting performance for collecting the toner scattered by the drive of the developing device toward the outside of the developing device was confirmed.

Here, the scattering preventing electrode 49 moves the negatively charged toner toward the developing sleeve 44 generally in the case where the two-component developer is used. However, the reversely (positively) charged toner and uncharged toner are deposited and gradually accumulated on the electrode 49. In the cases the developing device 4A in Comparative Embodiment 1 and a developing device 4B (FIG. 3(*b*)) in Comparative Embodiment 2, the electrode 49 is attached to the opening end of a developer feeding portion of the developing sleeve 44 in the developing container in general. This is an efficient constitution for exerting the electric field on the toner finally moved toward the outside of the developing container. However, in the case where the electrode is disposed at the opening end of the container in the constitution in which the developing sleeve 44 upwardly moves the developer with respect to the opposite drum surface, the following problem occurs. That is, there arises a problem when the uncharged or reversely charged toner is deposited and accumulated on the electrode 49, the accumulated toner is dropped. As factors for the dropping, there are dropping by the self-weight of the toner and impact exerted on the developing device when the cartridge including the developing device, the charging device, the cleaning device, and the like is demounted for maintenance in particular. The toner is dropped from the end of the container upper cover 48, thus being dropped in the drum opposite portion direction to reach the developing blade 46 located at a further lower portion. Thus, such a problem that the periphery of the developing device is contaminated with the toner scatter d by the dropping and the impact of collision is caused to occur.

Next, each of the developing device 4A in Comparative Embodiment 1 and the developing device 4 in Embodiment 1 was mounted in the image forming apparatus 100 and was subjected to the image forming operation, so that the amount of the toner falling in drops from the electrode 49 was compared. In the image forming apparatus 100, the voltage applied to the developing sleeve 44 is the oscillating bias, in the form of the DC voltage biased with the AC voltage, including a DC component of −400 V. The DC bias to be applied to the electrode 49 after the rectification is −1000 V, thus generating the potential difference of −600 V similarly as in the above-described idling test. Further, the drum 1 is supplied with the voltage of −650 V and the rotation shaft of the drum 1 is connected to the ground. In the setting described above, the image forming operation of an image with the image ratio of 5% is performed on 10,000 sheets (corresponding to that for 2 hours) equal to that in the idling test. The developing device was demounted from the image forming apparatus 100 when the toner was sufficiently deposited on the container upper cover 48 of the developing device, and the developing device was tapped three times on the floor, so that the amount of the toner dropped from the container upper cover 48 was compared. In this case, with respect to the container upper cover 48 of the developing device 4A in Comparative Embodiment 1, the toner dropped on the drum opposite portion of the developing sleeve 48 was observed. On the other hand, in the constitution of the container upper cover 48 of the developing device 4 in Embodiment 1, the toner is little dropped on the drum opposite portion of the developing sleeve 44, so that the toner contamination with respect to the outside of the developing device did not occur. As a result, it was confirmed in the constitution of the developing device in Embodiment 1 that the contamination of the inside of the image forming apparatus with the toner deposited on the scattering preventing electrode 49 and dropped on the outside of the developing device was prevented, so that it was possible to provide the developing device and image forming apparatus which were further excellent in maintenance performance.

FIG. 3(*c*) is a cross-sectional view of the developing device 4B in Comparative Embodiment 2. The developing device 4B is opposite in rotational direction to that of the developing device 4 in Embodiment 1 and the developing device 4A in Comparative Embodiment 1. Further, the cleaning blade 46 is disposed vertically on the developing sleeve 44. Further, the electrode 49 is disposed vertically below the developing sleeve 44 and is disposed vertically below the developing sleeve 44 at the opening-side end of the developing container. Also in comparison with the developing device 4B in Comparative Embodiment 2, the developing device 4 in Embodiment 1 was excellent in toner scattering preventing effect.

According to the constitution of the developing device in Embodiment 1, the position in which the scattered toner is collected by the electrode 49 can be located apart from the outside of the developing device and the toner deposited on the electrode 49 can be dropped on the developing sleeve 44 at the position in which the inclined surface of the developing sleeve 44 is directed to the inside of the developing container. For that reason, the contamination of the outside of the developing device with the scattered toner can be prevented or suppressed.

Embodiment 2

Figure 4:
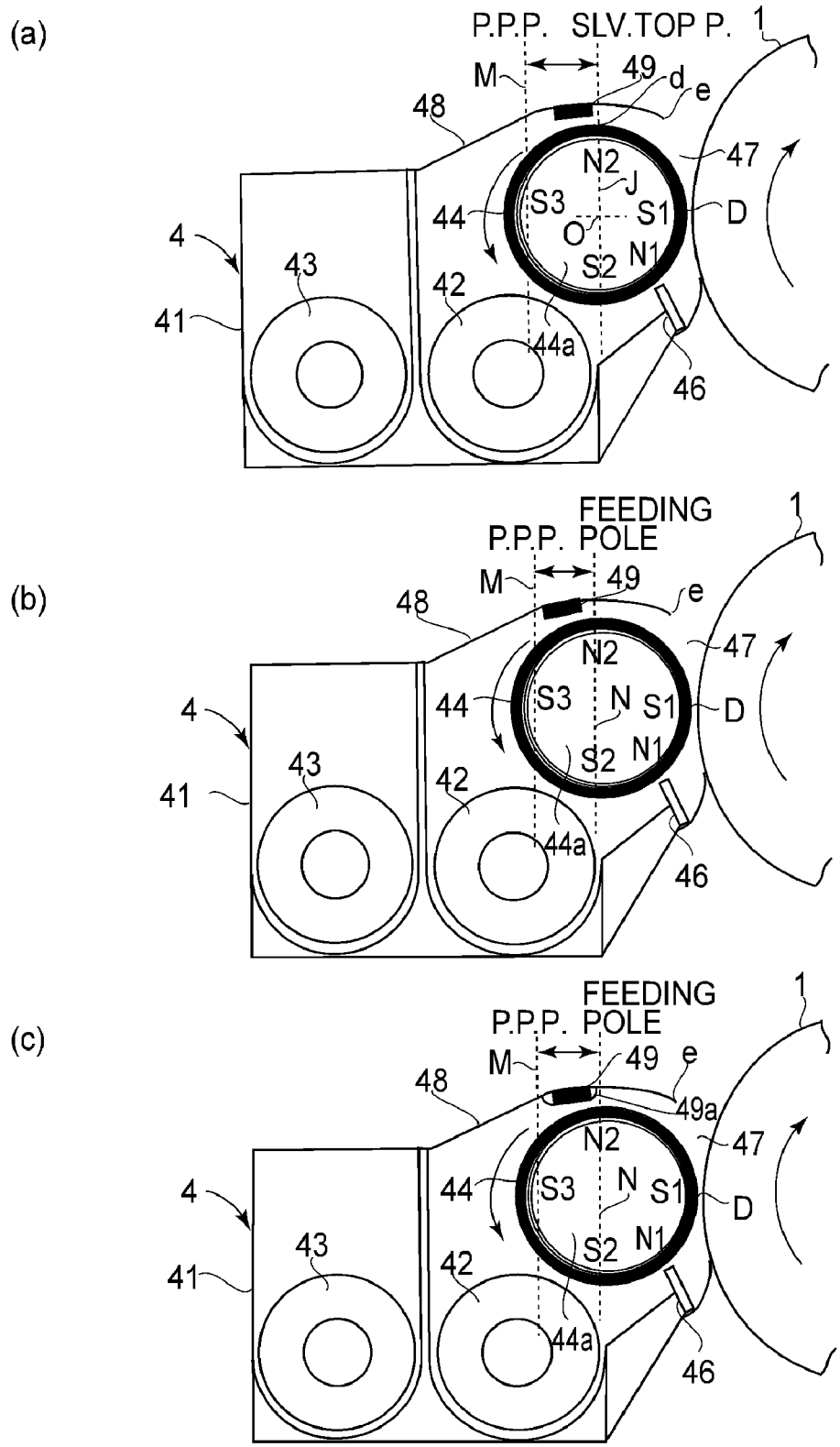
FIGS. 4(*a*), 4(*b*) and 4(*c*) are cross-sectional views of developing devices in Embodiments 2, 3 and 4, respectively.

FIG. 4(*a*) is a cross-sectional view of the developing device 4 in Embodiment 1. In this embodiment, in addition to the developing device constitution in Embodiment 1, such a constitution that the electrode 49 was disposed upstream, with respect to the developing sleeve rotational direction, of a peeling magnetic pole S3 of the magnet roller 44*a* for peeling the developer from the developing sleeve 44 as the developer carrying member was employed. In this embodiment, the electrode 49 is located downstream, with respect to the developing sleeve rotational direction, of the rectilinear line J passing through the rotation center O and top point d of the developing sleeve 44. Further, the electrode 49 is located upstream, with respect to the developing sleeve rotational direction, of a peeling pole position (P.P.P.). The magnet roller 44*a* contained in the developing sleeve 44 is constituted by magnet pieces (magnetic poles) consisting of 5 poles of S2, N1, S1, N2 and S3 in the order of movement of the developer from the inside of the developing container. The S2 pole is an attracting pole for attracting the developer to the developing sleeve 44. The N1 pole is a cutting pole for coating the developer in a thin layer at the position of the developing blade 46. The S1 pole is a developing pole for forming the chain of the developer at the drum opposite portion (developing zone D). The N2 pole is a feeding (conveying) pole for feeding (conveying) the developer to the inside of the developing container. The S3 pole is a peeling pole for peeling the developer from the developing sleeve 44 to be returned to the inside of the developing container. In this embodiment, the position of the electrode 49 was studied in the following manner by using the developing device idling method described in Embodiment 1. Here, the peeling pole position refers to a position of a vertical line M passing through the center of the peeling pole S3. The center of the peeling pole S3 in a position in which a peak of a magnetic field when the magnetic field is measured by a magnetic field measuring device. In the case where the electrode 49 is disposed downstream of the peeling pole position M with respect to the developing sleeve rotational direction, the toner dropped from the electrode 49 after the completion of the image forming operation and the voltage application moves in a long distance to directly strike against the developer surface in the developing container 41*a*. For that reason, the toner scatters by the collision, so that the scattered toner was deposited in a large amount on the white paper wound at the periphery of the developing device 4. Further, as in the developing device 4 in this embodiment, in the case where the electrode 49 is disposed upstream of the peeling pole position and downstream of the top point d of the developing sleeve 44 with respect to the developing sleeve rotational direction, the toner on the electrode 49 is dropped on the developing sleeve 44 at a position close to the electrode 49. For that reason, the scattering due to the impact of the dropped toner was little caused. As a result, the amount of the toner deposition was substantially equal to that in Embodiment 1. Similarly as in Embodiment 1, when the developing devices 4 having the above constitutions were subjected to the image forming operation and then the tapping, the same amount of the toner falling in drops obtained. As described above, by employing the constitution in which the electrode 49 is present downstream of the feeding pole N2 with respect to the developing sleeve rotational direction, the toner scattering due to the impact by dropping the developer in the developer feeding area is prevented, so that the toner does not scatter to the outside of the developing device. As a result, it was confirmed in the constitution of the developing device in Embodiment 2 that the ordinary toner scattering and the contamination of the inside of the image forming apparatus with the toner deposited on the scattering preventing electrode 49 and dropped on the outside of the developing device were prevented. As a result, it was possible to provide the developing device and image forming apparatus which were further excellent in maintenance performance.

Embodiment 3

FIG. 4(*b*) is a cross-sectional view of the developing device 4 in Embodiment 3. In this embodiment, in addition to the developing device constitution in Embodiment 2, such a constitution that the scattering preventing electrode 49 was disposed downstream, with respect to the developing sleeve rotational direction, of the feeding pole N2 as the feeding magnetic pole for feeding the developer from the developing zone D into the developing container was employed. Here, the feeding pole position is a position of a vertical line N passing through the center of the feeding pole N2. The vertical line N is degrees downstream of the rectilinear line J in FIG. 2(*a*) with respect to the sleeve rotational direction. In this embodiment, when the above constitution of the electrode 49 was employed and the electrode 49 right above the feeding pole N2 was disposed, each of the developing devices 4 having the above-described constitutions was subjected to the image forming operation similarly as in Embodiment 1. Each of the developing devices 4 was demounted from the image forming apparatus 100 and was subjected to tapping three times and ten times. Then, the amount of the toner discharged through the opening 47 locating between the container upper cover 48 of the developing device 4 and the developing sleeve 44 was compared. As a result of the third tapping, in both of the constitutions, the same dropping amount was confirmed with no discharge of the toner through the opening 47. However, after the tenth tapping, in the case of the constitution in this embodiment, little toner was discharged through the opening but on the other hand, in the constitution in which the electrode 49 was disposed right above the feeding pole N2, the toner deposited on the container upper cover 48 was discharged somewhat through the opening 47. As described above, in this embodiment, the electrode 49 is present downstream of the feeding pole position N with respect to the developing sleeve rotational direction. By this constitution, in the case where the toner is dropped from the electrode 49 onto the developing sleeve 44, it is possible to prevent the toner from scattering to the outside of the developing device by the formation of the chain of the developer at the feeding pole N2. As a result, it was confirmed in the constitution of the developing device in Embodiment 3 that the contamination of the inside of the image forming apparatus with the toner deposited on the scattering preventing electrode 49 and dropped on the outside of the developing device was prevented, so that it was possible to provide the developing device and image forming apparatus which were further excellent in maintenance performance.

Embodiment 4

FIG. 4(*c*) is a cross-sectional view of the developing device 4 in Embodiment 4. In this embodiment, in addition to the developing device constitution in Embodiment 3, such a constitution that the scattering preventing electrode 49 was surface-coated with a (coating) material having a developer (toner) parting property higher than that of the electrode 49 was employed. Specifically, a tape 49*a* of a tetrafluoroethylene resin material ("Teflon") was applied onto the electrode 49 of the sheet-like composite material ("AL-PET"), so that the toner parting property of the electrode 49 was enhanced. As the coating material 49*a*, other than the tetrafluoroethylene resin material, it is also possible to use other resins or solvents which are capable of increasing a contact angle of the surface of the electrode 49. Here, with respect to the material having the high developer parting property, the toner deposited on the scattering preventing electrode in uncharged or positively charged weakly in many cases. For this reason, as a factor of the high parting property for the electrode coating material, rather than an electrostatic deposition force between the toner and the material, the contact angle based on a frictional force or a liquid cross-linking force of the high parting property material is important. In the present invention, the contact angle refers to the contact angle of water measured by a drop shape analysis system (type "DSA 10Mk2", mfd. by KRUSS GmbH). Specifically, a droplet of distilled in an amount of 1.0 μl was disposed automatically on a sample. The sample was monitored and analyzed every 0.2 second for 10 seconds by a CCD camera. The tetrafluoroethylene resin material tape showed the contact angle of water of 112 degrees, thus possessing the high parting property. When the uncharged toner which has not contacted the carrier was actually placed in the amount of several grams on the tetrafluoroethylene resin material tape and then was inclined, most of the toner was slipped off the tape without being deposited on the tape. The developing device 4 in this embodiment and the developing device 4 in Embodiment 3 were subjected to the image forming operation in the image forming apparatus 100 on 10,000 sheets with an intermittent operation every 100 sheets and then were subjected to the tapping three times. Then, comparison between the developing devices in Embodiments 4 and 3 was made with respect to the amount of the toner dropped toward the drum opposite portion of the developing sleeve 44 and the amount of the toner deposited in the neighborhood of the electrode 49 on the back surface of the container upper cover 48. As a result, the amount of the dropped toner after the tapping was substantially equal in both of the developing devices 4, so that the toner was little dropped in both the developing devices 4. However, when the container upper cover 48 is detached from the developing container 41 and the amount of the toner deposited on the periphery of the electrode 49 was compared, the toner deposition amount in the constitution as in Embodiment 4 in which the electrode 49 was coated with the coating material 49*a* having the higher parting property than that of the electrode 49 was smaller than that in Embodiment 3. This is because the electrode 49 is coated with the coating material 49*a* to lower the toner deposition force on the electrode 49 and therefore the toner deposited with the timing when the bias applied to the electrode 49 is interrupted every 100 sheets is dropped periodically. As a result, by the constitution in Embodiment 4, it was possible to decrease the amount of the toner accumulated on the electrode 49 and therefore to decrease a degree of the contamination due to the toner dropping from the electrode 49. As described above, the surface of the electrode 49 is coated with the material having the higher developer (toner) parting property than that of the electrode 49, so that the amount of the toner left deposited on the electrode 49 can be kept at a minimum level. Thus, the amount of the toner falling in drops is decreased, so that the toner scattering to the outside of the developing device is prevented. As a result, it was confirmed in the constitution of the developing device in Embodiment 4 that the contamination of the inside of the image forming apparatus with the toner deposited on the scattering preventing electrode 49 and dropped on the outside of the developing device was prevented, so that it was possible to provide the developing device and image forming apparatus which were further excellent in maintenance performance.

Embodiment 5

Figure 5:
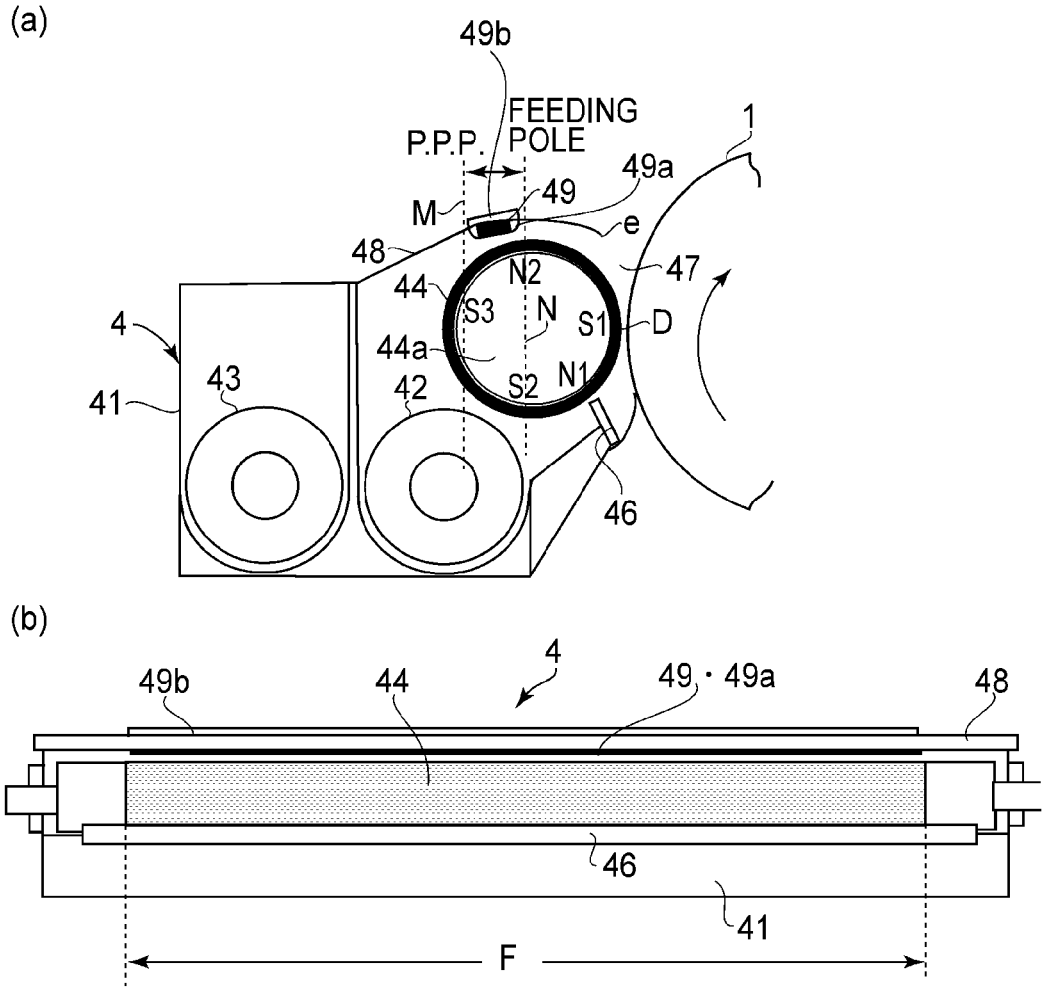
FIG. 5(*a*) is a cross-sectional view of a developing device in Embodiment 5 and FIG. 5(*b*) is a front view thereof.

FIG. 5(*a*) is a cross-sectional view of the developing device 4 in Embodiment 5. FIG. 5(*b*) is a front view of the developing device 4. In this embodiment, in addition to the developing device constitution in Embodiment 4, such a constitution that a vibrating device 49*b* is provided to the container upper cover 48 to transmit vibration to the electrode 49 so as to positively release (drop) the developer (toner) deposited on the electrode 49 was employed. In this embodiment, as the vibrating device 49*b*, a piezoelectric element was used. The vibrating device 49*b* using the piezoelectric element had a sheet-like shape and was disposed on the upper surface of the container upper cover 48 at the same position as the scattering preventing electrode 49 disposed on the lower (back) surface of the container upper cover 48 and was extended in the same length as that of the scattering preventing electrode 49 with respect to the longitudinal direction of the container upper cover 48. Then, comparison between the developing device 4 in Embodiment 5 and the developing device 4 in Embodiment 4 was made with respect to the amount of the dropped toner and the amount of the scattered toner deposition in the neighborhood of the scattering preventing electrode 49. In this embodiment, the vibration by the piezoelectric element 49*b* is executed after the completion of the image forming operation. For this purpose, in the image forming apparatus 100, the image forming operation was actually performed on 10,000 sheets with the intermittent operation every 100 sheets. Then, the developing devices 4 were detached from the image forming apparatus 100 and were subjected to the tapping ten times. Similarly as in Embodiment 4, the amount of the toner dropped on the drum opposite surface of the developing sleeve 44 and the amount of the toner deposited in the neighborhood of the scattering preventing electrode 49 of the container upper cover 48 were observed. In this case, the vibration by the piezoelectric element was performed for 1 second during the post-rotation after the job between two jobs with 100 sheet-intermittent operation. In the constitution of the developing device 4 in this embodiment, it was confirmed that the toner deposited on the scattering preventing electrode 49 was not dropped on the outside of the developing device 4 by the tapping. Further, when the toner deposition amount in the neighborhood of the scattering preventing electrode 49 was compared among the developing device constitutions in this embodiment (Embodiment 5), Embodiment 4 and Comparative Embodiment 1, the deposition amount is increased in the order of [Embodiment 5]<[Embodiment 4]<[Comparative Embodiment 1]. The vibrating device 49*b* can be provided on the surface of the container upper cover 48 opposite from the electrode 49 formed surface in the same length as that of the electrode 49 or can also be provided in a plurality of portions with respect to the longitudinal direction of the electrode 49. As described above, by providing the vibrating device, the amount of the toner falling in drops is decreased, so that the toner scattering to the outside of the developing device is prevented. As a result, it was confirmed in the constitution of the developing device in Embodiment 5 that the contamination of the inside of the image forming apparatus with the toner deposited on the scattering preventing electrode 49 and dropped on the outside of the developing device was prevented, so that it was possible to provide the developing device and image forming apparatus which were further excellent in maintenance performance.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 078965/2009 filed Mar. 27, 2009, which is hereby incorporated by reference.

What is claimed is:

1. A developing device comprising:

a developing container in which a developer including toner is contained;

a developer carrying member for carrying the developer and feeding the developer by rotation thereof to a developing zone in which said developer carrying member opposes an image bearing member on which a latent image is formed and develops the latent image with the developer; and an electrode, disposed opposed to said developer carrying member, to which a bias for forming an electric field for moving the developer including regular-charge toner in said developer container toward said developer carrying member is to be applied, wherein said electrode is disposed downstream of the developing zone with respect to a rotational direction of said developer carrying member and is disposed vertically above said developer carrying member, and wherein at least a part of said electrode is disposed downstream of a rectilinear line connecting a rotation center and top point of said developer carrying member with respect to the rotational direction of said developer carrying member.

2. A device according to claim 1, further comprising a magnetic member which is disposed inside said developer carrying member, and which has a plurality of magnetic poles including adjacent two magnetic poles having the same polarity, wherein said electrode is disposed upstream of a vertical line passing through a magnetic pole, of the two magnetic poles, which is disposed upstream, with respect to the rotational direction of said developer carrying member, of the other magnetic pole of the two magnetic poles.

3. A device according to claim 1, further comprising a magnetic member which is disposed inside said developer carrying member, and which has a plurality of magnetic poles, wherein said electrode is disposed downstream of a vertical line passing through a magnetic pole, of the magnetic poles, which is disposed adjacently downstream, with respect to the rotational direction of said developer carrying member, of another magnetic pole, of the magnetic poles, closest to the image bearing member.

4. A device according to claim 1, wherein said electrode is disposed entirely downstream of the rectilinear line connecting the rotation center and top point of said developer carrying member with respect to the rotational direction of said developer carrying member.

5. A device according to claim 1, wherein a surface of said electrode is covered with a material having a developer parting property higher than that of said electrode.

* * * * *